US006206308B1

(12) United States Patent
Seltman

(10) Patent No.: US 6,206,308 B1
(45) Date of Patent: Mar. 27, 2001

(54) METHOD TO OBTAIN WOOD WITH WEAK FIBRE CONNECTIONS

(76) Inventor: Joachim W. O. Seltman, Bondestigen 29, Rönninge (SE), SE-144 37

( * ) Notice: Subject to any disclaimer, the term of this patent is extended or adjusted under 35 U.S.C. 154(b) by 0 days.

(21) Appl. No.: 09/355,611

(22) PCT Filed: Jan. 31, 1997

(86) PCT No.: PCT/SE97/00152

§ 371 Date: Sep. 30, 1999

§ 102(e) Date: Sep. 30, 1999

(87) PCT Pub. No.: WO98/33969

PCT Pub. Date: Aug. 6, 1998

(51) Int. Cl.[7] ..... B02C 19/12
(52) U.S. Cl. ..... 241/1; 241/28; 241/29
(58) Field of Search ..... 241/1, 301, 29, 241/28, 152.2

(56) References Cited

U.S. PATENT DOCUMENTS 3,801,432 4/1974 Free .
5,075,131 12/1991 Hattori et al. .

FOREIGN PATENT DOCUMENTS 9502741 4/1998 (SE) .

*Primary Examiner*—Mark Rosenbaum
(74) *Attorney, Agent, or Firm*—Young & Thompson

(57) ABSTRACT

A method and an arrangement for obtaining wood in which the tracheids have less ability to bind to each other. The end surface of the wood is irradiated with pulsed laser light of such strength, and with such a number of pulses, that lignin-related cellulose and hemicellulose bonds break up along the light-conducting middle lamella to a depth which is sufficient to ensure that reduction of the wood (to paper pulp) via mechanical processes can be done more quickly, more gently and with greater efficiency.

9 Claims, No Drawings

METHOD TO OBTAIN WOOD WITH WEAK FIBRE CONNECTIONS

BACKGROUND OF THE INVENTION

The present invention relates to a method for separating fibers from a section of wood;

When producing mechanical pulp from wood, the fibres are separated from the wood by means of the wood being pressed against a grindstone or metal disc. Water is added to the process, on the one hand to carry off the excess heat and an the other hand to conduct the wood fibres away.

At a defined flow of water, the temperature can be held in the range of 100–200° C. preferably around 150° C. This facilitates the process of extraction of the fibres from the unit of wood since on the one hand the latter is moistened and on the other hand it is heated. However, the heating must not attain such a level as to cause an undesired molecular breakdown of the cellulose. On the other hand, the morphological complex of cellulose, hemicellulose and lignin is to be loosened.

By means of this method, the fibre is not damaged as much as it is in cold grinding, with a great deal of water, where essentially all the excess heat is carried off. In cold grinding, the fibre is broken off or torn off at too many locations, and the paper produced from cold-ground pulp thus loses strength. A moderate shredding of the fibre is aimed for, however, in order to increase the opacity of the paper, compared to chemical pulp.

SUMMARY OF THE INVENTION

An object of the invention is to free fibre from wood in a gentle way. Another object is to separate fibre more quickly. Yet another object of the invention is to separate the fibre in a manner which is more energy-efficient.

DESCRIPTION OF THE PREFERRED EMBODIMENTS

According to the invention, the wood is irradiated with pulsed light having a high pulse power. On irradiating the end surface, the light penetrates several centimetres into the wood and breaks some of the bonds which are holding the fibres in the wood structure. At long wavelengths of the pulsed light, heating effects occur which give rise to vaporization of liquid in the wood. The vapour formed assists in cracking the fibre. The subsequent mechanical grinding process frees the fibres more gently and utilizes less energy. An energy saving of 10% would mean about 200 kWh less energy per ton of pulp.

Wood is made up of fibres which are bound to each other along areas which are called middle lamellas. This expression is familiar to a specialist in the field. The middle lamellas for the most part comprise lignin-related cellulose and hemicellulose bonds which thus constitute a binding agent. The fibres are in turn made up of fibrils which are also connected to each other by means of lignin-related cellulose and hemicellulose bonds.

According to a development of the invention, the wood is irradiated using pulsed light which has a wavelength in the range of 150–300 nm. When the light at this wavelength range, and with a predetermined power, passes through the air on its way towards the wood, ozone is formed. The ozone penetrates the wood together with the pulsed light and breaks dawn lignin-related cellulose and hemicellulose bonds in the wood. This irradiation process means that the paper which is made from the paper pulp is less transparent, which is desirable for newsprint paper, for example. The predetermined energy of the pulsed light should at least correspond to the same order of magnitude as the binding energy of the lignin-related cellulose and hermicellulose bonds. Energy of this magnitude is created using, for example, an excimer laser, which is known per se to the specialist and which does not therefore need to be discussed in any more detail here.

During the irradiation process, liquid is preferably added to the wood in fluid form or in the form of vapour in order to prevent the broken-up lignin-related cellulose and hemicellulose bonds from attempting to create new bonds.

According to one embodiment, the process for manufacturing mechanical pulp from wood can be carried out as follows. Wood is cut into sections of a predetermined size, which can be adapted to the size permitted by the machine in which the process is being carried out. The wood is irradiated with pulsed light directed at one surface of the wood, which surface can be an and surface of the wood. The surface can consist of a transverse cut, a tangential cut or a radial cut through the wood. These cuts are defined by a specialist in the field. The pulsed light reaches a defined depth in the section of wood. Thereafter, the fibres are separated mechanically from the section of wood. This mechanical separation can be carried out by means of a suitable machining process, such as grinding, milling, or planing. The mechanical separation of the fibres should not substantially exceed the depth in the section of wood to which the pulsed light has reached.

During the mechanical separation, water is preferably added in order, on the one hand, to carry off the heat which arises during the machining process, and, on the other hand, to carry away the fibres which have been separated from the section of wood. The water should be added to the machining process at a flow velocity which is such that the temperature of the section of wood can be held in the range of 100–200° C.

The process for manufacturing mechanical pulp then continues with alternate irradiation and mechanical separation.

During the irradiation using pulsed light, the lignin-related cellulose and hemicellulose bonds which bind together the fibrils of the fibres are also loosened. This means that in the mechanical separation the fibres can more easily be split or crack along their longitudinal direction. Because the lignin in the middle lamellas and in the area between the fibrils is loosened or removed by the irradiation or light exposure with the pulsed light, the finished paper is less transparent.

After the mechanical separation of the fibres, these can be treated with light of a predetermined wavelength in order to remove remains of lignin from the fibres and to expose fibrils to the desired extent.

Pulsed light is preferably used for the irradiation of the wood, but it is conceivable that the light does not need to be pulsed. As an alternative, continuous irradiation of the wood can be carried out.

It is also conceivable for a laser of the so-called YAG type or TEA type to be used as a step in the manufacturing process in order to raise the irradiated surface of the wood.

What is claimed is:

1. A method for separating fibers from a section of wood, the method comprising the steps of:

cutting wood into sections of a predetermined size;

irradiating the sections of wood with light of such light density that bonds break along middle lamellas in the irradiated wood to a depth in the sections of wood reached by the light, so that the bonds between fibers of the wood are loosened;

separating the fibers mechanically from the sections of wood to the depth which the light has reached; and alternating irradiation with light and mechanical separation until the fibers are separated from the sections of wood.

2. The method according to claim 1, wherein the wood is irradiated on an end surface using light which has a wavelength chosen from infrared to ultraviolet until a proportion of the bonds are broken.

3. The method according to claim 1, wherein the light treatment is carried out using UV laser light.

4. The method according to claim 1, wherein the wood is irradiated with a light wavelength which is chosen such that ozone is formed in the air surrounding the wood, and the ozone gas formed contributes to the breaking up and loosening of the bonds between the fibers.

5. The method according to claim 1, wherein the wood is irradiated with the light in pulsed form and with a sufficient number of pulses to ensure that the bonds between the fibers are loosened.

6. The method according to claim 1, wherein a liquid in fluid form or in the form of vapor is added to the wood during the light irradiation.

7. The method according to claim 1, wherein the fibers are separated from the section of wood by means of a grinding process.

8. The method according to claim 1, wherein a predetermined flow of liquid is added to the separation process.

9. The method according to claim 1, wherein the fibers, after being mechanically separated, are treated with light at a predetermined wavelength in order to remove residues of lignin from the fibers and to expose fibrils to the desired extent.

* * * * *